United States Patent [19]

Hasegawa et al.

[11] 4,225,398

[45] Sep. 30, 1980

[54] METHOD OF IMPROVING THE CORROSION RESISTANCE OF AN ANODICALLY OXIDIZED SURFACE FILM ON ALUMINUM ARTICLES

[75] Inventors: Mutsuo Hasegawa, Uozu; Hatsuo Hirono, Nyuzen; Katsuyuki Nagata, Uozu; Shinji Hayashi, Toyama; Hiroshi Yamagata, Kurobe, all of Japan

[73] Assignee: Yoshida Kogyo K.K., Japan

[21] Appl. No.: 889,443

[22] Filed: Mar. 23, 1978

[30] Foreign Application Priority Data

Mar. 30, 1977 [JP] Japan ..... 52-34735
Mar. 30, 1977 [JP] Japan ..... 52-34736
Mar. 30, 1977 [JP] Japan ..... 52-34737

[51] Int. Cl.[2] ..... C25D 11/18; C25D 11/20; C25D 11/22

[52] U.S. Cl. ..... 204/33; 204/35 N; 204/37 R

[58] Field of Search ..... 204/33, 38 A, 35 N, 204/37 R, 42

[56] References Cited

U.S. PATENT DOCUMENTS

| | | | |
|---|---|---|---|
| 3,340,164 | 9/1967 | Zimmerman | 204/35 N |
| 3,468,766 | 9/1969 | Lang | 204/35 N |
| 3,472,742 | 10/1969 | Webb | 204/33 |
| 3,565,772 | 2/1971 | Richaud et al. | 204/33 |
| 3,704,176 | 11/1972 | Oga et al. | 148/6.27 |
| 3,785,936 | 1/1974 | Alburger | 204/38 A |
| 3,852,124 | 12/1974 | Fassell | 204/38 A |
| 3,902,976 | 9/1975 | Walls | 204/38 A |
| 3,935,349 | 1/1976 | Terai | 204/38 A |
| 3,960,676 | 6/1976 | Miyosawa | 204/38 A |

OTHER PUBLICATIONS

Fred Pearlstein, Sealing Anodized Aluminum, Metal Finishing Aug. 1960, pp. 40–43.

Wernick and Pinner, Surface Treatment and Finishing of Aluminum and Its Alloys, Robert Draper, Ltd. 1956, pp. 354–369.

*Primary Examiner*—John H. Mack
*Assistant Examiner*—William Leader
*Attorney, Agent, or Firm*—Hill Van Santen, Steadman, Chiara & Simpson

[57] ABSTRACT

The corrosion resistance of an anodically oxidized surface film on aluminum articles is improved by sealing micropores and the like in such surface film with an aqueous sealing solution or dispersion containing siliceous material, such as silicic acid or a silicate, therein and thereafter overcoating the so-sealed surface with a select coating composition. The aqueous sealing solution is brought into contact with the aluminum article, such as by dipping the article into the solution and drying the so-coated article. Optionally, an electrical voltage may be applied through the sealing liquid and through the aluminum article during the sealing process. Further, in certain embodiments an electrical voltage may be applied through the sealing liquid before the liquid contacts the aluminum article. If desired, the surface of the aluminum article may be colored prior to sealing.

8 Claims, No Drawings

METHOD OF IMPROVING THE CORROSION RESISTANCE OF AN ANODICALLY OXIDIZED SURFACE FILM ON ALUMINUM ARTICLES

BACKGROUND OF THE INVENTION

1. Field of the Invention

The invention relates to a method of providing a corrosion resistant coating film on an anodically oxidized surface film on an article composed of aluminum or an aluminum-based alloy.

2. Prior Art

In the prior art, several methods are known for sealing micropores or pinholes and the like in an anodically oxidized surface film of an article composed of aluminum or an aluminum-based alloy, including sealing with pressurized steam, sealing with boiling water as well as sealing with chemicals, such as certain salt compounds, for example nickel acetate, cobalt acetate and the like. When the anodically oxidized surface film of an article composed of aluminum or an aluminum-based alloy is subjected to sealing by the above prior art methods, such surface film is then overcoated with a layer of a coating composition and the underlying anodically oxidized surface film tends to crack or the like during application of such layer. Such cracks or surface discontinuities are caused during the drying process utilized with the coating compositions wherein drying is usually undertaken at a temperature of 140° C. or higher and results in an inferior adhesion of the coating film to the underlying surface, yields an inferior appearance and inferior mechanical properties of the coating film and provides a relatively poor corrosion resistance to the thus-coated article. Therefore, it is a generally accepted practice in the art to seal aluminum articles by coating such articles with a low temperature-drying coating composition curable at temperatures of 140° C. or lower, in spite of the disadvantageous properties of coating films obtained from such low temperature-drying coating compositions in comparison with films obtained from high temperature-drying coating compositions. In attempting to balance these problems, selection of a coating composition useful on aluminum articles is subject to narrow limitations and the properties of the coating films, i.e. adhesion to the underlying surface and corrosion resistance are never completely satisfactory.

As is well known, on the other hand, coating with a high temperature-drying coating composition is usually preceded by a sealing of micropores and the like in the anodically oxidized surface film with a synthetic resin. Such sealing treatment may occur by means of electrodeposition or dipping, prior to overcoating with a select high temperature-drying coating composition. With this type of treatment and with the simultaneous hydration sealing, utilizing the moisture within the coating composition and a high temperature curing or drying, crack formations and the like are avoided. However, a small amount of sealing liquid, for example, sulfuric acid, often remains adsorbed in the micropores within the unsealed or partially sealed anodically oxidized surface film. An aluminum article having such a sealing film on an anodically oxidized surface film is defective due to the poor corrosion resistance as well as the low wear resistance and poor durability and adhesion of the coating film.

In addition, electrolytic coloring of an anodically oxidized surface film, for example, in accordance with the method suggested by Asada (Japanese Patent Publication No. 38-1715), wherein a metal oxide at a lower oxidation state is deposited electrolytically on the anodically oxidized surface film, causes yet further problems, i.e. a degradation of any coating film applied on top of such colored aluminum occurs. It appears that the degradation of the coating film may be caused by a migration of the coloring substances out of the micropores or by a migration of the metal into the electro-deposited coating films.

Processes of improving the corrosion resistance of articles comprised of aluminum or an aluminum-based alloy by coating surfaces thereof with compositions, which are either of the high temperature-drying type or the low temperature-drying type, are defective in many ways, particularly by failing to provide coating films having desired properties, such as good adhesion to the underlying surface, good wear resistance and the like, good resistance against alkali solution, hydrochloric acid, saline solution, sulfurous acid solutions etc., and good weathering resistance on outdoor exposure. The prior art procedures apparently fail to completely seal micropores and the like in the anodically oxidized surface film on articles comprised of aluminum or an aluminum-based alloy and thus yield coated articles with inferior properties.

SUMMARY OF THE INVENTION

An object of the invention is, therefore, to present a novel and improved method of providing sealing and coating films on an anodically oxidized surface film of an article comprised of aluminum or an aluminum-based alloy which are free from the above described prior art problems. The invention is the result of an extensive investigation by the inventors and comprises the discovery that sealing treatment of an anodically oxidized surface film on an article comprised of aluminum or an aluminum-based alloy is materially improved when such sealing is carried out in a hot aqueous liquid containing a siliceous material, such as silicic acid or a silicate, which is soluble or dispersible in water, prior to overcoating the so-treated surface with a select coating composition. This sealing treatment results in several advantages in that:

(1) no cracks are formed in the anodically oxidized surface film after the sealing treatment, even when it is coated with a high temperature-drying coating composition of any select type, i.e. aqueous solutions, organic solutions or aqueous dispersions by means of electrodeposition, dipping or electrostatic coating, followed by heat drying at 140° C. or higher;

(2) the high temperature-drying coating composition can be freely selected in accordance with a desired end use of the coated articles;

(3) no difficulty is encountered from electrophoresis during coating by electrodeposition due to an extreme increase in electrical resistance of the so-sealed anodically oxidized surface film; and (4) excellent coating films can be obtained on so-sealed surface film irrespective of the coating means utilized and yield films with good adhesion and wear resistance as well as strong corrosion resistance against alkali solutions, acids, saline solutions and the like.

Further, it was unexpectedly discovered that an electrical pretreatment of the aqueous sealing liquid yields still better coating results, such as when an electric voltage is applied to the sealing liquid prior to its use. Principles of the invention are also applicable to treatment of aluminum article surfaces colored by any conventional means and followed by anodic oxidation.

DETAILED DESCRIPTION OF THE PREFERRED EMBODIMENTS

In accordance with the principles of the invention, any shaped article comprised of aluminum or an aluminum-based alloy which includes one or more alloying element, such as silicon, magnesium, copper, nickel, zinc, chromium, lead, bismuth, iron, titanium, manganese and the like, may be treated. The shape of the aluminum articles being treated is not limited and may comprise plates, pipes, rods, extruded bars with irregular or regular cross sections, articles formed by deep drawing and pressing as well as by other means. Such aluminum articles are typically subjected to anodic oxidation of their surfaces by passing a DC electric current through an acidic electrolyte solution, for example containing sulfuric acid, oxalic acid or sulfamic acid, and between the aluminum article arranged as the anode and a cathode arranged as the counterelectrode, preferably after degreasing and washing in a conventional manner.

The aluminum article provided with an anodically oxidized surface film and after washing with water, is then subjected to the inventive sealing treatment so as to seal the micropores, pinholes and other like surface irregularities in the oxide layer by contacting at least the oxide surface film (although typically the entire article will be immersed within the sealing liquid) with an aqueous sealing liquid containing siliceous material, such as a silicic acid or a silicate, dissolved or dispersed therein.

Among the silicic acids and silicates soluble or dispersible in water and suitable for the practice of the invention are silicic acids and silicates defined by the general formula:

$$xM_2O.ySiO_2$$

wherein M is an alkali metal, x is a number between 1 and 10, and y is a number between 10 and 100. Other inorganic silicate compounds and silicates having organic groups therein are also useful in the practice of the invention and specific compounds suitable for the practice of the invention are exemplified by orthosilicic acid, metasilicic acid, sodium silicates, potassium silicates, borosilicates, potassium aluminum silicates, sodium aluminum silicates, sodium methylsilicates, potassium methylsilicates, sodium butylsilicates, sodium propylsilicates, lithium propylsilicates, triethanol ammonium silicates, tetramethanolamine silicates, hexafluorosilicic acid, zinc hexafluorosilicate, ammonium hexafluorosilicate, cobalt hexafluorosilicate, iron hexafluorosilicate, sodium hexafluorosilicate, nickel hexafluorosilicate, barium hexafluorosilicate, hydroxyammonium hexafluorosilicate, mixtures thereof and other similar organic and inorganic siliceous materials.

The concentration of the siliceous materials dissolved or dispersed in aqueous sealing formulations of the invention is preferably in the range from about 0.005 to about 60 g/liter and, more preferably, in the range from about 0.03 to about 30 g/liter, although recognizable and useful effects can be obtained with even an extremely low concentration, for example, a siliceous material concentration as low as a few p.p.m. (parts per million). The sealing may be performed by merely contacting, as by dipping or immersion, an anodically oxidized surface of the aluminum article in an aqueous sealing liquid at an elevated temperature of, for example, 80° C. or higher for a time period of less than 30 minutes and preferably for a time period ranging from about 2 to 20 minutes. Of course, in a typical usage, the entire aluminum article is immersed or dipped into the aqueous sealing liquid. The foregoing sealing treatment yields excellent sealing results, for example, in regard to corrosion resistance in comparison with conventional sealing methods, such as with chemicals or boiling water. If the concentration of the siliceous material within the sealing liquid is outside the above specified range, undesirable drawbacks are noted in the performance and appearance of the finished aluminum articles, as well as in the stability of the aqueous sealing liquid. Further, if the temperature of the sealing liquid is lower than 80° C., undesirable drawbacks are also noted, for example, a less satisfactory appearance of the finished aluminum article is attained and/or a lower electrical conductivity is exhibited by such low temperature sealing liquid in instances where the sealing treatment is conducted electrolytically.

Additional improvements are obtained by adding small amounts (typically in the range of about 0.005 to 10 g/liter) of a polyvalent alcohol, i.e. glycerin, ethyleneglycol, propyleneglycol, diethyleneglycol and the like, a surface active agent such as a cationic, an anionic, a nonionic and/or an amphoteric surface active agent, a defoaming composition or a chelating agent into the aqueous sealing liquid containing the siliceous material.

Instead of a simple dipping or immersion of the aluminum article or the oxidized surface film thereof in an aqueous sealing liquid as explained above, further improvements in the sealing effect and corrosion resistance of the finished aluminum article may be obtained by electrolytically conducting the sealing treatment. In such electrolytic sealing treatment, an AC, DC or a DC-biased AC voltage of 200 volts or less and preferably ranging from about 5 to 110 volts, may be applied between the aluminum article and a stainless steel electrode immersed within the aqueous sealing liquid, with the aluminum article functioning as the cathode and a stainless steel electrode functioning as the anode, in the case of DC voltage application. The frequency of the AC voltage, if utilized, is not limited but typically, a commercial frequency of 50 or 60 Hz may be utilized. The length of time and temperature of this electrolytic sealing treatment is typically the same as with simple contacting or dipping.

It has also been discovered that improved results in the properties of the coating films and the appearance of finished aluminum articles, as well as the stability of the aqueous sealing liquid can be obtained by subjecting the aqueous sealing liquid containing the siliceous material, prior to its use, to an electrical pretreatment in which an AC, DC or DC-biased AC voltage of 110 volts or less (and preferably ranging from about 5 to 15 volts) is applied between electrodes of, for example, stainless steel immersed in the aqueous sealing liquid for a period of time of about 2 to 20 minutes. The mechanism by which improvements are obtained with the above electrical pretreatment of the sealing liquid is not presently well understood but it is presumed that the application of electric voltage contributes to a better colloidal or the like dispersion of the siliceous material in the aqueous sealing liquid. Of course, other theories may better explain the observed phenomena and the invention is not limited to any particular explanation or theory.

The effect of the sealing treatment as described above by the use of an aqueous sealing liquid containing a siliceous material (i.e. a silicic acid or a silicate), which is referred to hereinafter as a primary sealing treatment, is further completed by a secondary sealing treatment in a conventional prior art manner. Accordingly, the parameters of the secondary sealing treatment are not limited and the following is merely a recommendation of procedures useful in obtaining beneficial results.

Secondary sealing treatment with pressurized steam may be conducted with steam at a pressure of about 3 to 6 kg/cm$^2$G for about 10 minutes or longer. Alternatively, a secondary sealing treatment may also be effected with boiling or hot water wherein the article being treated is contacted with hot water at a temperature of at least 95° C. for at least about 10 minutes. Optionally, boiling or hot water may contain sodium carbonate, ammonia or triethanolamine as an auxiliary additive in a concentration of about 0.005 to 1 g/liter. Of course, other secondary sealing treatments may also be utilized.

The secondary sealing treatment may also be effectively conducted chemically with a secondary sealing liquid containing a salt selected from a group consisting of nickel salts, such as nickel acetate, molybdenum salts, such as ammonium molybdate, phosphate salts such as sodium dihydrogenphosphate, and/or bichromate salts, such as sodium bichromate as well as mixtures of the foregoing salts. For example, a formulation of secondary sealing liquid for the above secondary sealing treatment may comprise the following formulations and conditions.

In a secondary sealing with a nickel salt solution, a solution containing a mixture of 2 to 5 grams of nickel acetate per liter of water, 1 gram of cobalt acetate per liter of water and 2 to 5 grams of boric acid per liter of water is prepared and the pH thereof adjusted to a pH range of 5 to 6. At least during usage the temperature of the resultant solution is adjusted to about 70° C. or higher, and the article being treated is maintained in contact with the foregoing solution for a period of time in the range of about 2 to 30 minutes.

In a secondary sealing with a phosphate salt solution, a solution containing about 0.03 grams of sodium or ammonium dihydrogenphosphate per liter of water is prepared and the pH thereof adjusted to a pH of about 5 to 6. At least in usage, the temperature of such solution is adjusted to at least 95° C. and the article is maintained in contact with such solution for a period of time ranging from about 2 to 30 minutes.

In a secondary sealing treatment with a bicarbonate salt solution, a solution is prepared containing 50 to 100 grams of sodium bicarbonate per liter of water and, optionally, 18 grams of sodium carbonate per liter of water and the pH of this solution is adjusted to about 6.5 to 7.5. At least during usage, the temperature of the solution is adjusted to at least 95° C. and the article being treated is maintained in contact with such solution for a period of time ranging from about 2 to 20 minutes.

In secondary sealing treatment with a molybdate salt solution, a solution is prepared containing 1 to 2 grams of ammonium or sodium molybdate per liter of water and the pH of the solution is adjusted to 5.5 to 8.0. At least during usage, the temperature of the solution is adjusted to at least 90° C. and the article being treated is maintained in contact with such solution for about 2 to 30 minutes.

It is, of course, optional whether the primary sealing treatment of the invention with an aqueous sealing liquid containing a siliceous material is preceded by a coloring of the anodically oxidized surface film on the aluminum articles being treated. The coloring may be performed by any conventional electrolytic or chemical process.

During electrolytic coloring, electrolysis is conducted with an electrolyte solution prepared in accordance with known methods by adding small amounts of a metal salt of an inorganic or organic acid into an aqueous solution containing an inorganic or organic acid or ammonis or an amino or imino salt of such acid. The anions of the inorganic or organic salts above mentioned include nitrates, sulfates, chlorides, phosphates, borates, chromates, oxalates, acetates, tartrates and the like and the cations thereof include nickel, cobalt, copper, chromium, tin, selenium, molybdenum, gold and the like. The concentration of these metal salts in the electrolyte solution is typically in the range of about 5 to 500 g/liter. The electrolysis is typically performed with a power source of about 5 to 75 volts of AC voltage, however, it is also possible to perform the electrolysis with a DC voltage or a DC-biased AC voltage. A voltage higher than about 75 volts typically destroys the oxidized surface film on the aluminum article and no useful coloring is obtained.

Chemical coloring may also be performed by dipping or immersing the aluminum article with an anodically oxidized surface film thereon in a solution of iron (ferric) sodium oxalate or iron (ferric) ammonium oxalate, present in a concentration of about 1 to 10 grams per liter and maintained at a temperature of about 40° to 70° C. for a period of time of about 1 to 10 minutes.

The aluminum article may, after having been subjected to the above described primary and secondary sealing treatments, and if necessary, after having been washed with water and dried, be then coated with a finishing coating composition. The finishing coating composition may be any conventional finishing coating composition, including aqueous solution types, aqueous dispersion types and organic solution types. One of the greatest advantages of the sealing treatment in accordance with the invention is that a finishing coating composition with a drying or curing temperature of 140° C. or higher (which was not used in the prior art because of the problems of crack formation and insufficient adhesion), can be safely and advantageously used as the finishing coating. With respect to a finishing coating with a high temperature-drying composition, a method is disclosed in Japanese Patent Publication 47-51092, which is a combination of a primary sealing treatment with a solution of metal salt and a secondary sealing treatment with electrodeposition of a thermosetting resin, followed by curing in a drying oven. In contrast, the method of the present invention yields excellent sealing effects with only a single treatment and, in addition, the invention allows versatility in the selection of the coating process, including coating by electrodeposition, coating by dipping as well as coating by an electrostatic process.

In summarizing the invention, the advantages obtained by the practice of the invention are not limited to improvements of corrosion resistance of an anodically oxidized surface film of an aluminum article but also include avoidance of difficulties in quality control and avoidance of inferior appearance of the coating film. For example, unsealed or partially sealed oxide films, due to residual impurities, such as sulfate ions in the micropores are completely eliminated by the use of an aqueous sealing liquid containing a siliceous material in accordance with the principles of the invention. The corrosion resistance of the aluminum articles obtained by the above primary sealing treatment of the invention is further strengthened by a secondary sealing treatment with pressurized steam, boiling water and/or chemicals against attack by alkali, acid and/or saline solutions and consequently finished aluminum articles having complex coating films produced in accordance with the principles of the invention are superior in corrosion resistance against hydrochloric and/or sulfurous acid solutions, exhibit superior wear resistance and have superior adhesion to the underlying surface as well as exhibit an improved physical appearance.

With the foregoing general discussion in mind, there are presented detailed examples and comparative controls of the present invention to illustrate to those skilled in the art the principles of the invention in further detail. However, these examples are provided merely as an aid in the understanding of the invention and variations may be made by those skilled in the art without departing from the spirit and scope of the invention.

In the following examples and comparative controls, the anodically oxidized aluminum articles were subjected to a primary sealing treatment with a siliceous material-containing sealing liquid and, optionally, to a secondary sealing treatment and then coated with a finishing coating composition in three different ways, as set forth below. The thus-finished aluminum articles were subjected to an examination of the sealing effect on the articles, from which the coating films had been removed with a paint remover. An examination of the properties of the complex coating films themselves was also undertaken. The coating procedures utilized, designated (A), (B), and (C), the testing procedure utilized for the sealing effect and the testing procedure utilized for determining the properties of the complex coating films are summarized below.

Coating procedure (A): Electrodeposition with a water-soluble coating composition was carried out with an aluminum article immersed in the coating composition (the particular siliceous material and/or other ingredients thereof are specified below in each example) having a solid content of about 12% by weight at 22° C. The aluminum article being coated was utilized as the anode and a stainless steel rod was utilized as the cathode. 140 to 180 volts of DC voltage was applied between the anode and the cathode for about 2 minutes, followed by washing with water and heat drying at about 180° C. for 40 minutes. The so-attained coating film had a thickness of about 8 μm.

Coating procedure (B): An aluminum article was dipped or immersed in a water-soluble coating composition comprised of a thermosetting acrylic resin having a solid content of about 26% by weight at 40° C. The so-immersed aluminum article was gradually pulled out of the coating composition at a speed of about 1 meter/minute and then maintained in ambient atmosphere at 35° C. for about 10 minutes, followed by oven drying at 180° C. for 40 minutes. The so-attained coating film had a thickness of about 8 μm.

Coating procedure (C): An aluminum article was spray-coated with a thermosetting acrylic resin coating composition diluted with about an equal amount of a thinner solvent and applied with a spray gun driven by compressed air at a pressure of about 4 kg/cm$^2$ G, followed by drying at 180° C. for about 20 minutes. The so-attained coating film had a thickness of about 8 μm.

Testing Procedure For The Sealing Effect (1) An alkali solution dropping test by the procedure specified in JIS H 8681.

(2) A so-called Cass test by the procedure specified in JIS H 8681, with a testing time of 8 hours.

(3) A so-called Cape test, with visual inspection of the appearance and a determination of any change in the thickness of the surface film after an immersion of about 30 minutes of the coated article being tested in an aqueous solution, which was prepared by dissolving 10 grams of sodium sulfite per liter of water, followed by a two step adjustment of the pH thereof, first to a pH of 3.75 with glacial acetic acid and then to a pH of 2.5 with 5-normal sulfuric acid at 92° C.

Testing Procedure For The Properties Of The Coating Film (1) Adhesion of the coating film was determined by the procedure specified in JIS A 4706.

(2) An impact test on the coating film was undertaken with a DuPont impact tester which utilized a 1000 gram probe having a ¼ inch radius falling from a height of 50 centimeters onto the film.

(3) An alkali corrosion test was conducted by the procedure specified in JIS A 4706, after an immersion of the film for 72 hours in a 1% NaOH solution.

(4) A sulfuric acid corrosion test was conducted by the procedure specified in JIS A 4706, after immersion of the film for 72 hours in a 5% $H_2SO_4$ solution.

(5) A hydraulic acid corrosion test was conducted by the procedure specified in JIS A 4706, but with a 5% HCl solution after immersion of the film for 72 hours in such solution.

(6) A Cass test was conducted by the procedure specified in JIS K 5400, and by subjecting the film to 72 hours of spraying with a saline solution.

(7) A corrosion test with sulfurous acid solution was conducted by immersing the film for 30 hours in a 1% aqueous solution of sulfuric acid at 25° C.

(8) A corrosion test with boiling water was conducted by immersing the film for 5 hours in water heated at a temperature of 98° C. or higher.

The results of the above test procedures were rated in 5 grades, (I) through (V), with the following standards:

(I)—Excellent or no change at all
(II)—Good
(III)—Fairly good
(IV)—Poor
(V)—Bad

EXAMPLE 1

EXPERIMENTS NO. 1 TO NO. 6

Six extruded aluminum bars having an H-shaped cross section, designated A-6063S by JIS, were, after cleansing, degreasing, etching, etc. to remove foreign matter therefrom, anodically oxidized in a 17.5% sulfuric acid solution at 20° C. by passing a DC electric current between the aluminum bars immersed in such solution and coupled as the anode and another aluminum rod coupled as the cathode, with a current density of 1.3 A/cm$^2$ by applying 16 volts of such DC voltage for about 30 minutes to yield an anodically oxidized surface film on each bar having a thickness of about 12 μm. Thereafter, the so-attained surface film was washed with water. The aluminum bars thus anodically oxidized on the surface thereof were subjected to a primary sealing treatment by being immersed in aqueous sealing liquids containing the siliceous materials at varied concentration, varied pH values, varied temperatures and treat times as set forth below in Table I and dried at room temperature. The so-treated aluminum bars were then overcoated with a coating composition in at least one of the three different ways mentioned before.

The parameters of the sealing treatment and coating as well as the results of the testing undertaken for these coated aluminum bars are summarized in Table I below.

TABLE I

| Experiment No. | | 1 | 2 | 3 | 4 | 5 | 6 |
|---|---|---|---|---|---|---|---|
| Sealing treatment | Silicic acid or silicate (g/liter) | Silicic acid (0.03) | Sodium silicate (0.03) | Sodium silicate (0.05) + triethanol ammonium silicate (0.05) | Sodium silicate (10) | Sodium silicate (0.1) | Triethanol ammonium silicate (0.1) |
| | pH | 5.5 | 10 | 10 | 10 | 10 | 10 |
| | Temperature. °C. | 98 | 98 | 98 | 98 | 80 | 98 |
| | Time, minutes | 20 | 20 | 20 | 10 | 20 | 20 |
| Coating procedure | | A(180 V) | A(180 V)<br>B<br>C | A(180 V) | A(180 V) | A(150 V) | A(180 V) |
| Coating film | Appearance | (I) | A (I)<br>B (I)<br>C (II) | (I) | (I) | (I) | (I) |
| | Cracks | None | Each, None | None | None | None | None |
| | Adhesion | 100/100 | Each, 100/100 | 100/100 | 100/100 | 100/100 | 100/100 |
| Sealing effect after removal of coating film | Alkali dropping(seconds) | 65 | Each, 65 | 65 | 60 | 50 | 65 |
| | Cass test (RN)[1] | 10 | Each, 10 | 10 | 9.8–10 | 9.8 | 10 |
| | Cape test | (III) | Each, (III) | (III) | (III) | (IV) | (III) |
| Corrosion test of coating film | 1% NaOH | (I) | A (I)<br>B (I)<br>C (II) | (I) | (I) | (II) | (I) |
| | 5% $H_2SO_4$ | (I) | Each (I) | (I) | (I) | (I) | (I) |
| | 5% HCl | (II) | A (II)<br>B (II)<br>C (III) | (II) | (II) | (III) | (II) |
| | 1% $SO_2$ | (II) | A (II)<br>B (II)<br>C (III) | (II) | (II) | (III) | (II) |
| | Cass test | (I) | A (I)<br>B (II)<br>C (III) | (I) | (I) | (I) | (I) |
| | Boiling water | (I) | A (I)<br>B (II)<br>C (III) | (I) | (I) | (I) | (I) |

[1]Rate Number

COMPARATIVE CONTROL EXPERIMENTS NO. 7 TO NO. 11

Except for the process of sealing treatment, the same procedure was repeated in these experiments as set forth in Example 1 above, however, instead of the sealing liquid containing a siliceous material, in the controls, the sealing treatment was performed with deionized water at 80° C. (Experiment Nos. 7 and 11), nearly boiling water at 98° C. (Experiment No. 8), pressurized steam at 5 kg/cm$^2$ G pressure (Experiment No. 9), an aqueous solution containing 5 g/liter of nickel acetate, 1 g/liter of cobalt acetate and 4 g/liter of boric acid (Experiment No. 10). In Experiment No. 11, the aluminum bar anodically oxidized on the surface thereof was subjected to an electrolytic coloring procedure before the sealing treatment, while in the other experiments, the aluminum bars were not colored. The conditions of the treatment and results of the testing undertaken with these aluminum bars are summarized in Table II below.

TABLE II

| Experiment No. | | 7 | 8 | 9 | 10 | 11 |
|---|---|---|---|---|---|---|
| Electrolytic coloring | Method | No Hot Water | No Boiling Water | No Pressurized steam | No Chemicals | Yes Hot Water |
| Sealing or semi-sealing | pH | 7 | 7 | — | 5.5 | 7 |
| | Temperature, °C. | 80 | 98 | — | 98 | 80 |
| | Time, minutes | 10 | 20 | 30 | 20 | 10 |
| | Coating procedure | A (130 V) | A (160 V) | A (180 V) | A (160 V) | A (130 V) |

TABLE II-continued

| Experiment No. | | 7 | 8 | 9 | 10 | 11 |
|---|---|---|---|---|---|---|
| | | B | | | | B |
| | | C | | | | C |
| | Appearance | A (III) | (III) | (III) | (III) | A (III) |
| Coating film | | B (III) | | | | B (III) |
| | | C (IV) | | | | C (IV) |
| | Cracks | Each, none | Yes | Yes | Yes | Each, none |
| | Adhesion | A 98/100 | 80/100 | 80/100 | 70/100 | A 98/100 |
| | | B 98/100 | | | | B 98/100 |
| | | C 80/100 | | | | C 98/100 |
| | Alkali dropping, sec. | Each, 30 | 60 | 160 | 65 | Each, 30 |
| Sealing effect after removal of coating film | Cass test (RN)[1] | Each, 9.0 | 9.5 | 9.8-10 | 9.8 | Each, 9.5 |
| | Cape test | Each, (IV) | (III) | (II) | (III) | Each, (IV) |
| | 1% NaOH | A (III) | | | | A (II) |
| | | B (IV) | — | — | — | B (III) |
| Corrosion test of coating film | | C (V) | | | | C (V) |
| | 5% $H_2SO_4$ | A (I) | — | — | — | A (I) |
| | | B (I) | | | | B (I) |
| | | C (II) | | | | C (II) |
| | 5% HCL | A (IV) | — | — | — | A (III) |
| | | B (IV) | | | | B (IV) |
| | | C (V) | | | | C (V) |
| | 1% $SO_2$ | A (IV) | — | — | — | A (III) |
| | | B (IV-V) | | | | B (IV) |
| | | C (V) | | | | C (V) |
| | Cass test | A (II) | — | — | — | A (II) |
| | | B (IV) | | | | B (IV) |
| | | C (V) | | | | C (V) |
| | Boiling water | A (II) | — | — | — | A (II) |
| | | B (IV) | | | | B (IV) |
| | | C (V) | | | | C (V) |

[1]Rate Number

EXAMPLE 2

(EXPERIMENTS NO. 12 to No. 14)

Following the primary sealing treatment with an aqueous sealing liquid containing a siliceous material as specified in Example 1, a secondary sealing treatment was undertaken with pressurized steam (Experiment No. 12), boiling water (Experiment No. 13) or an aqueous solution containing sodium dihydrogenphosphate (Experiment No. 14).

The conditions of the treatment and the results of the testing undertaken for the thus-treated and coated aluminum bars are summarized in Table III below.

TABLE III

| Experiment No. | | 12 | 13 | 14 |
|---|---|---|---|---|
| Primary sealing treatment | Silicic acid or silicate (g/liter) | Sodium silicate (0.05) | Sodium silicate (0.05) | Silicic acid (0.05) |
| | pH | 10 | 10 | 5.5 |
| | Temperature, °C. | 98 | 98 | 98 |
| | Time, minutes | 10 | 10 | 10 |
| | Pressurized steam | 5 kg/cm$^2$G, 30 minutes | — | — |
| Secondary sealing treatment | Boiling water | — | 98° C., 10 mins. | — |
| | Phosphate solution | — | — | (*) |
| Coating procedure | | A (200 V) | A (190 V) | A (180 V) |
| Coating film | Appearance | (II) | (II) | (I) |
| | Cracks | None | None | None |
| | Adhesion | 100/100 | 100/100 | 100/100 |
| | Alkali dropping, sec. | 170 | 70 | 80 |
| Sealing effect after removal of coating film | Cass test (RN)[1] | 10 | 10 | 10 |
| | Cape test | (II) | (III) | (III) |
| Corrosion test of coating film | 1% NaOH | (I) | (II) | (I) |
| | 5% $H_2SO_4$ | (I) | (I) | (I) |
| | 5% HCl | (I) | (II) | (II) |
| | 1% $SO_2$ | (II) | (II) | (II) |
| | Cass test | (I) | (II) | (I) |
| | Boiling water | (I) | (I) | (I) |

(*) Sodium dihydrogen phosphate 0.03 g/liter; pH 5.5; temperature 95° C.; and treatment time 10 minutes
[1]Ibid

EXAMPLE 3

(EXPERIMENTS NO. 15 to NO. 20)

The experimental procedures specified in Example 1 were repeated, except that certain additives (indicated in Table IV below) were added to the aqueous sealing liquids (Experiments No. 15 to No. 17) or, in addition to the use of additives to the sealing liquid, a secondary sealing treatment was also undertaken with pressurized steam at 5 kg/cm$^2$ G pressure for about 30 minutes (Experiment No. 18) or with the same salt solution as defined in Experiment No. 10, along with further additives as set forth in Table IV below (Experiment No. 20).

The conditions of the treatment and the results of the testing undertaken for the thus-treated and coated aluminum bars are summarized in Table IV below.

TABLE IV

| Experiment No. | | 15 | 16 | 17 | 18 | 19 | 20 |
|---|---|---|---|---|---|---|---|
| Primary sealing treatment | Silicic acid or silicate (g/liter) | Sodium silicate (0.05) | Silicic acid (0.05) | Sodium silicate (0.05) | Sodium silicate (0.05) | Sodium silicate (0.03) + triethanol ammonium silicate (0.03) | Silicic acid (0.05) |
| | Additive (g/liter) | Diethylene glycol (0.01) | EDTA** (0.1) + $NaH_2PO_4$ (0.02) | $NaH_2PO_4$ (0.03) | Diethylene glycol (0.01) | $NaH_2PO_4$ (0.03) | EDTA** (0.03) + $NaH_2PO_4$ (0.03) |
| | pH | 10 | 5.5 | 9 | 10 | 10 | 5.5 |
| | Temperature, °C. | 98 | 98 | 98 | 98 | 98 | 98 |
| | Time, minutes | 10 | 10 | 10 | 20 | 20 | 20 |
| | Electrolysis (volts) | — | — | — | AC (15) | AC/DC (15) | AC (15) |
| Secondary sealing treatment | | No | No | No | Yes | No | Yes |
| Coating Procedure | | A(180 V) | A(180 V) | A(180 V) | A(200 V) | A(190 V) | A(180 V) |
| Coating film | Appearance | (I) | (I) | (I) | (I) | (I) | (I) |
| | Cracks | None | None | None | None | None | None |
| | Adhesion | 100/100 | 100/100 | 100/100 | 100/100 | 100/100 | 100/100 |
| Sealing effect after removal of coating film | Alkali dropping (seconds) | 65 | 65 | 70 | 180 | 70 | 85 |
| | Cass test (RN)[1] | 10 | 9.8–10 | 10 | 10 | 10 | 10 |
| | Cape test | (III) | (III) | (III) | (III) | (III) | (III) |
| Corrosion test of coating film | 1% NaOH | (I) | (I) | (I) | (I) | (I) | (I) |
| | 5% $H_2SO_4$ | (I) | (I) | (I) | (I) | (I) | (I) |
| | 5% HCl | (II) | (II) | (II) | (I) | (II) | (II) |
| | 1% $SO_2$ | (II) | (II) | (II) | (II) | (II) | (II) |
| | Cass test | (I) | (II) | (I) | (I) | (I) | (I) |
| | Boiling water | (I) | (I) | (I) | (I) | (I) | (I) |

**EDTA = ethylenediaminetetracetic acid
[1]Ibid

EXAMPLE 4

(EXPERIMENTS NO. 21 to NO. 25)

Substantially identical experimental procedures as set forth in Example 1 were repeated, except that each aqueous sealing liquid was subjected, prior to its use (i.e., prior to contact with the aluminum bars) to a pretreatment by applying 5 volts of AC voltage between stainless steel electrodes immersed in the sealing liquid. The other conditions of the sealing procedure were essentially identical with those set forth in Example 1.

The conditions of treatment and results of the testing undertaken for the thus-treated and coated aluminum bars are summarized in Table V below.

TABLE V

| Experiment No. | | 21 | 22 | 23 | 24 | 25 |
|---|---|---|---|---|---|---|
| Sealing treatment | Silicic acid or silicate (g/liter) | Silicic acid (0.03) | Sodium silicate (0.03) | Sodium silicate (0.05) + triethanol ammonium silicate (0.05) | Sodium silicate (0.05) | Triethanol ammonium silicate (0.1) |
| | pH | 5.5 | 10 | 10 | 10 | 10 |
| | Temperature, °C. | 98. 98 | 98 | 98 | 98 | |
| | Time, minutes | 20 | 20 | 20 | 20 | 20 |
| Coating procedure | | A (180 V) | A (180 V) B C | A (180 V) | A (180 V) | A (180 V) |
| Coating film | Appearance | (I) | Each, (I) | (I) | (I) | (I) |
| | Cracks | None | Each, None | None | None | None |
| | Adhesion | 100/100 | Each, 100/100 | 100/100 | 100/100 | |
| Sealing | Alkali dropping (seconds) | 65 | Each, 65 | 65 | 65 | 65 |

TABLE V-continued

| Experiment No. | | 21 | 22 | 23 | 24 | 25 |
|---|---|---|---|---|---|---|
| effect after removal of coating film | Cass test (RN)[1] | 10 | Each, 10 | 10 | 10 | 10 |
| | Cape test | (III) | Each, (III) | (III) | (III) | (III) |
| Corrosion test of coating film | 1% NaOH | (I) | Each, (I) | (I) | (I) | (I) |
| | 5% $H_2SO_4$ | (I) | Each, (I) | (I) | (I) | (I) |
| | 5% HC) | (II) | Each, (II) | (II) | (II) | (II) |
| | 1% $SO_2$ | (II) | Each, (II) | (II) | (II) | (II) |
| | Cass test | (I) | A (I)<br>B (II)<br>C (II) | (I) | (I) | (I) |
| | Boiling water | (I) | A (I)<br>B (II)<br>C (III) | (I) | (I) | (I) |

[1]Ibid

EXAMPLE 5

(EXPERIMENTS NO. 26 to No. 31)

The experimental procedures utilized in this group of experiments was substantially the same as that utilized in Example 4, except that a secondary sealing treatment was undertaken in each of the experiments with pressurized steam at 5 kg/cm$^2$G pressure for about 30 minutes (Experiments No. 26 and No. 30), with nearly boiling water at 98° C. for about 10 minutes (Experiment No. 27) or with an aqueous solution containing 0.03 g/liter of sodium dihydrogenphosphate with a pH of 5.5 for about 10 minutes (Experiment Nos. 28, 29 and 31). In addition, the aqueous sealing liquids used in the primary sealing treatment in Experiment Nos. 29–31 were each admixed with 0.01 g/liter of diethylene glycol as an additive and the primary sealing procedure in Experiment No. 30 was performed electrolytically by applying 15 volts of AC voltage between the aluminum bar being treated and a stainless steel counterelectrode. The aluminum bar used in Experiment No. 31 had been electrolytically colored on its surface prior to the sealing treatment.

The conditions of the treatment and the results of the testing undertaken for the thus-treated and coated aluminum bars are summarized in Table VI below.

TABLE VI

| Experiment No. | | 26 | 27 | 28 | 29 | 30 | 31 |
|---|---|---|---|---|---|---|---|
| Primary Sealing treatment | Silicic acid or silicate (g/liter) | Sodium silicate (0.05) | Sodium silicate (0.05) | Silicic acid (0.05) | Sodium silicate (0.05) | Sodium silicate (0.05) | Sodium silicate (0.05) |
| | Additive (g/liter) | None | None | None | Diethylene glycol (0.01) | Diethylene glycol (0.01) | Diethylene glycol (0.01) |
| | pH | 10 | 10 | 5.5 | 10 | 10 | 10 |
| | Temperature, °C. | 98 | 98 | 98 | 98 | 98 | 98 |
| | Time, minutes | 10 | 10 | 10 | 20 | 20 | 20 |
| | Electrolysis (volts) | No | No | No | No | AC (15) | No |
| Secondary sealing | Pressurized steam | yes | — | — | — | Yes | — |
| | Boiling wter | — | Yes | — | — | — | — |
| | Phospate solution* | — | — | Yes | Yes | — | Yes |
| Coating procedure | | A (200 V) | A (190 V) | A (180 V) | A (180 V) | A (200 V) | A (180 V) |
| | Appearance | (I) | (I) | (I) | (I) | (I) | (I) |
| Coating film | Cracks | None | None | None | None | None | None |
| | Adhesion | 100/100 | 100/100 | 100/100 | 100/100 | 100/100 | 100/100 |
| Sealing effect after removal of coating film | Alkali dropping (seconds) | 170 | 70 | 80 | 75 | 180 | 85 |
| | Cass test (RN)[1] | 10 | 10 | 10 | 10 | 10 | 10 |
| | Cape test | (II) | (III) | (III) | (III) | (III) | (III) |
| Corrosion testing of coating film | 1% NaOH | (I) | (I) | (I) | (I) | (I) | (I) |
| | 5% $H_2SO_4$ | (I) | (I) | (I) | (I) | (I) | (I) |
| | 5% HCl | (I) | (II) | (II) | (II) | (I) | (II) |
| | 1% $SO_2$ | (II) | (II) | (II) | (II) | (II) | (II) |
| | Cass test | (I) | (I) | (I) | (I) | (I) | (I) |
| | Boiling water | (I) | (I) | (I) | (I) | (I) | (I) |

[1]Ibid
*Ibid

EXAMPLE 6

(EXPERIMENTS NO. 32 to NO. 39)

The conditions of the treatment and results of the testing undertaken for the thus-treated and coated aluminum bars are summarized in Table VII below.

TABLE VII

| Experiment No. | | 32 | 33 | 34 | 35 | 36 | 37 | 38 | 39 |
|---|---|---|---|---|---|---|---|---|---|
| Coloring | Electrolytic | Yes | — | Yes | Yes | Yes | Yes | Yes | Yes |
| | Chemical | — | Yes | — | — | — | — | — | — |
| Primary sealing treatment | Silicic acid or silicate (g/liter) | Sodium silicate (0.03) | Sodium silicate (0.03) | Sodium silicate (0.05) | Silicic acid (0.05) | Sodium silicate (0.05) | Sodium silicate (0.05) | Sodium silicate (0.05) | Sodium silicate (0.03) + triethanol ammonium silicate (0.03) |
| | Additive (g/liter) | None | None | None | None | Diethylene glycol (0.01) | $NaH_2PO_4$ (0.03) | Diethylene glycol (0.01) | $NaH_2PO_4$ (0.03) |
| | pH | 10 | 10 | 10 | 5.5 | 10 | 9 | 10 | 10 |
| | Temperature, °C. | 98 | 98 | 98 | 98 | 98 | 98 | 98 | 98 |
| | Electrolysis (volts) | — | — | — | — | — | — | AC (15) | AC/DC (15) |
| Secondary sealing | Pressurized steam | — | — | Yes | — | — | — | Yes | — |
| | Phospate solution* | — | — | — | Yes | — | — | — | — |
| Coating procedure | | A (180 V) B C | A (180 V) | A (200 V) | A (180 V) | A (180 V) | A (180 V) | A (200 V) | A (190 V) |
| Coating film | Appearance | Each (I) | (I) | (I) | (I) | (I) | (I) | (I) | (I) |
| | Cracks | Each None | None | None | None | None | None | None | None |
| | Adhesion | Each 100/100 | 100/100 | 100/100 | 100/100 | 100/100 | 100/100 | 100/100 | 100/100 |
| Sealing effect after removal of coating film | Alkali dropping (seconds) | Each, 75 | 65 | 180 | 90 | 75 | 80 | 190 | 80 |
| | Cass test (RN)[1] | Each, 10 | 10 | 10 | 10 | 10 | 10 | 10 | 10 |
| | Cape test | Each, (III) | (III) | (II) | (III) | (III) | (III) | (II) | (III) |
| Corrosion test of coating film | 1% NaOH | A (I) B (I) C (II) | (I) | (I) | (I) | (I) | (I) | (I) | (I) |
| | 5% $H_2SO_4$ | Each, (I) | (I) | (I) | (I) | (I) | (I) | (I) | (I) |
| | 5% HCl | Each, (II) | (II) | (I) | (II) | (II) | (II) | (I) | (II) |
| | 1% $SO_2$ | A (II) B (II) C (III) | (II) | (I) | (II) | (II) | (II) | (II) | (II) |
| | Cass test | A (I) B (II) C (III) | (I) | (I) | (I) | (I) | (I) | (I) | (I) |
| | Boiling water | A (I) B (I) C (III) | (I) | (I) | (I) | (I) | (I) | (I) | (I) |

[1]Ibid
*Ibid

Extruded bars of aluminum were anodically oxidized on their surfaces as set forth in Example 1 and, prior to the sealing treatment, subjected to a coloring process, either (1) electrolytically, by dipping the aluminum bar in an electrolyte solution which was prepared by dissolving 30 g/liters of $NiSO_4.6H_2O$, 25 g/liter of $H_3BO_3$ and 15 g/liter of $(NH_4)_2SO_4$ in water and adjusting the pH of the resultant solution to 5.6 at 25° C. The aluminum bars were maintained in the foregoing electrolyte solution for about 5 minutes with the application of 15 volts of DC voltage through the electrolyte and the immersed bars, or (2) chemically, by dipping the aluminum bars in an aqueous solution containing 5 g/liters of sodium iron (ferric) oxalate adjusted to a pH of 5.2 to 45° C. for about 3 minutes and 40 seconds. The sealing treatments and coating were then carried out in much the same manner as in the preceding examples, with the materials in the sealing liquid and conditions of treatment as set out in Table VII below.

As is apparent from the foregoing specification, the present invention is susceptible of being embodied with various alterations and modifications which may differ particularly from those that have been described in the preceding specification and description. For this reasons, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A method of providing a coating film onto an oxide film on a surface of an anodically oxidized aluminum article, comprising, in combination, the seqential steps of:

(a) subjecting an aluminum article having an anodically oxidized surface film to a sealing treatment of any micropores in said surface film by contacting said aluminum article with an aqueous sealing liquid at a temperature of at least 80° C. containing therein an amount in the range of about 0.03 to 30 g/liters of siliceous material selected from the group consisting of silicic acid, a silicate and mixtures thereof at least dispersible in an aqueous liquid, said contacting occurring over a time interval ranging from about 2 to 20 minutes;

(b) subjecting the so-sealed aluminum article to a secondary sealing treatment selected from the group consisting of contacting said aluminum article to pressurized steam, contacting said aluminum article to boiling water and contacting said aluminium article with a secondary sealing liquid containing a chemical selected from the group consisting of a nickel salt, a molybdenum salt, a phosphate salt, a bichromate salt and mixtures thereof; and (c) coating the thus-treated aluminum article with a coating composition chemically different from said liquids of steps (a) and (b) and curing the so-applied coating composition at a temperature of at least 180° C.

2. A method as defined in claim 1 wherein said aqueous sealing liquid includes a polyvalent alcohol.

3. A method as defined in claim 1 wherein said step (a) is performed electrolytically by applying an electric voltage between said aluminum article and a counterelectrode immersed in said aqueous sealing liquid.

4. A method as defined in claim 3 wherein the electric voltage is in the range of about 5 to 110 volts.

5. A method as defined in claim 1 wherein said aqueous sealing liquid is, prior to step (a), subjected to a pretreatment by applying an electrical voltage between a pair of operational electrodes immersed therein.

6. A method as defined in claim 5 wherein the electric voltage is in the range of about 5 to 15 volts.

7. A method as defined in claim 5 wherein said pretreatment includes a time duration in the range of about 2 to 20 minutes.

8. A method as defined in claim 1 wherein said oxide film is subjected to an electrolytic coloring procedure prior to step (a).

* * * * *